US005199500A

United States Patent [19]

Norman et al.

[11] Patent Number: 5,199,500

[45] Date of Patent: Apr. 6, 1993

[54] SEVERABLE COVER FOR EXPLOSION AND FIRE SUPPRESSION NOZZLES

[75] Inventors: James M. Norman, Lenexa, Kans.; Bruce McLelland, Blue Springs; William V. Henry, Lee's Summit, both of Mo.

[73] Assignee: Fike Corporation, Blue Springs, Mo.

[21] Appl. No.: 860,801

[22] Filed: Mar. 30, 1992

[51] Int. Cl.[5] ..... A62C 3/00; A62C 39/00

[52] U.S. Cl. ..... 169/51; 169/54; 239/104; 239/309

[58] Field of Search ..... 169/51, 54, 37, 26, 169/28, 57, 58, 65; 239/309, 288, 104

[56] References Cited

U.S. PATENT DOCUMENTS

| | | | |
|---|---|---|---|
| 399,519 | 3/1889 | Grinnell | 169/37 |
| 676,221 | 6/1901 | Davis | 169/37 |
| 1,766,912 | 6/1930 | Laengel | 169/26 |
| 1,909,837 | 5/1933 | Laengel | 169/26 |
| 2,712,881 | 7/1955 | Mathisen | 169/28 X |
| 2,742,094 | 4/1956 | Mathisen | 169/28 |
| 2,766,832 | 10/1956 | Mathisen | 169/28 X |
| 2,890,758 | 6/1959 | Pfalzgraff et al. | 169/37 |
| 4,328,867 | 5/1982 | Heath | 169/58 |
| 4,964,470 | 10/1990 | Gaulin | 169/54 X |
| 5,031,701 | 7/1991 | McLelland et al. | 169/28 X |

*Primary Examiner*—David M. Mitchell
*Assistant Examiner*—James M. Kannofsky
*Attorney, Agent, or Firm*—Hovey, Williams, Timmons & Collins

[57] ABSTRACT

A fire or explosion suppression system provided with a source of pressurized suppressant and an apertured release suppressant nozzle which extends into the area protected by the system is provided with a cover unit which prevents the nozzle from becoming clogged or impeded by solid materials present in the protected zone. The cover unit that envelops the nozzle is of elastomeric material and has four internal grooves defining lines of weakness which present a cross-pattern. Upon release of the suppressant, the cover unit ruptures along the lines of weakness whereby the petal-shaped areas of the unit defined by the grooves open up for free flow of suppressant therepast.

10 Claims, 3 Drawing Sheets

SEVERABLE COVER FOR EXPLOSION AND FIRE SUPPRESSION NOZZLES

BACKGROUND OF THE INVENTION

1. Field of the Invention

This invention relates generally to fire or explosion suppression systems provided with a source of pressurized liquid or finely divided solid suppressant and a suppressant release nozzle. The nozzle, which typically has a series of end orifices and side discharge openings for controlling the delivery path of the suppressant, extends into the area protected by the system. The nozzle orifices and openings tend to become clogged or impeded by materials which are present in the area protected by the suppressant system.

Many flow paths such as conduits, as well as processing vessels contain solid materials, usually in a finely divided state, which can agglomerate or cling to any projection into the flow path or processing area. This is especially true as to materials which are somewhat hygroscopic in nature and therefore will collect on any impediment to the flowpath to the material.

Thus, this invention is especially concerned with a protective cover unit for suppressant discharge nozzles, wherein the cover unit is constructed to rupture under the pressure of released suppressant, in a manner defining a series of controlled petals rather than fragmenting into pieces which would be released into the protected area.

2. Description of the Prior Art

Fire or explosion suppression systems having a pressurized suppressant which is discharged into a protected area through a nozzle extending into that area have long been provided with a nozzle cover for preventing partial or total clogging of the nozzle orifices by materials in the protected zone. However, the covers have been of the type which results in there being forced off of the nozzle into the protected area upon release of suppressant.

This has the undesirable effect of contaminating the protected area with the cover material, either as a complete unit, or as fragmented pieces. In the case of food processes, or other chemical systems, it is not desirable that those processes or systems be contaminated with the nozzle cover upon release of suppressant.

SUMMARY OF THE INVENTION

This invention concerns a cover unit for the nozzle of a fire or explosion suppression system which envelops the end orifices and side discharge openings in the nozzle to prevent clogging or agglomeration on the surfaces of the nozzle by the materials that are present in the area being protected.

Specifically, the cover unit, which is fabricated of neoprene or an equivalent elastomer, has generally cylindrical side wall structure capped by an integral semi-cylindrical end section. The cylindrical side wall and end cap section are provided with V-shaped grooves in the inner surfaces thereof which define lines of weakness presenting a cross-shaped pattern having its apex at the outermost end of the cap section.

The lines of weakness of the cover unit sever under a pressure less than that required to rupture the remainder of the side wall portion and end cap section of the cover unit whereby upon release of suppressant for delivery through the nozzle into the protected area, the cover unit ruptures along the lines of weakness producing petals which open but do not fragment as the suppressant flows therepast into the protected zone. As a consequence, the cover unit as a whole is not released into the protected area, nor does the cover unit fragment so that pieces thereof would be discharged into the area being protected.

A flange integral with the cylindrical side wall of the cover unit remote from the semi-cylindrical end cap section facilitates mounting of the cover unit on structure defining a part of the area protected by the suppression system.

BRIEF DESCRIPTION OF THE PRIOR AS DEPICTED IN FIG. 3

Figure 3:
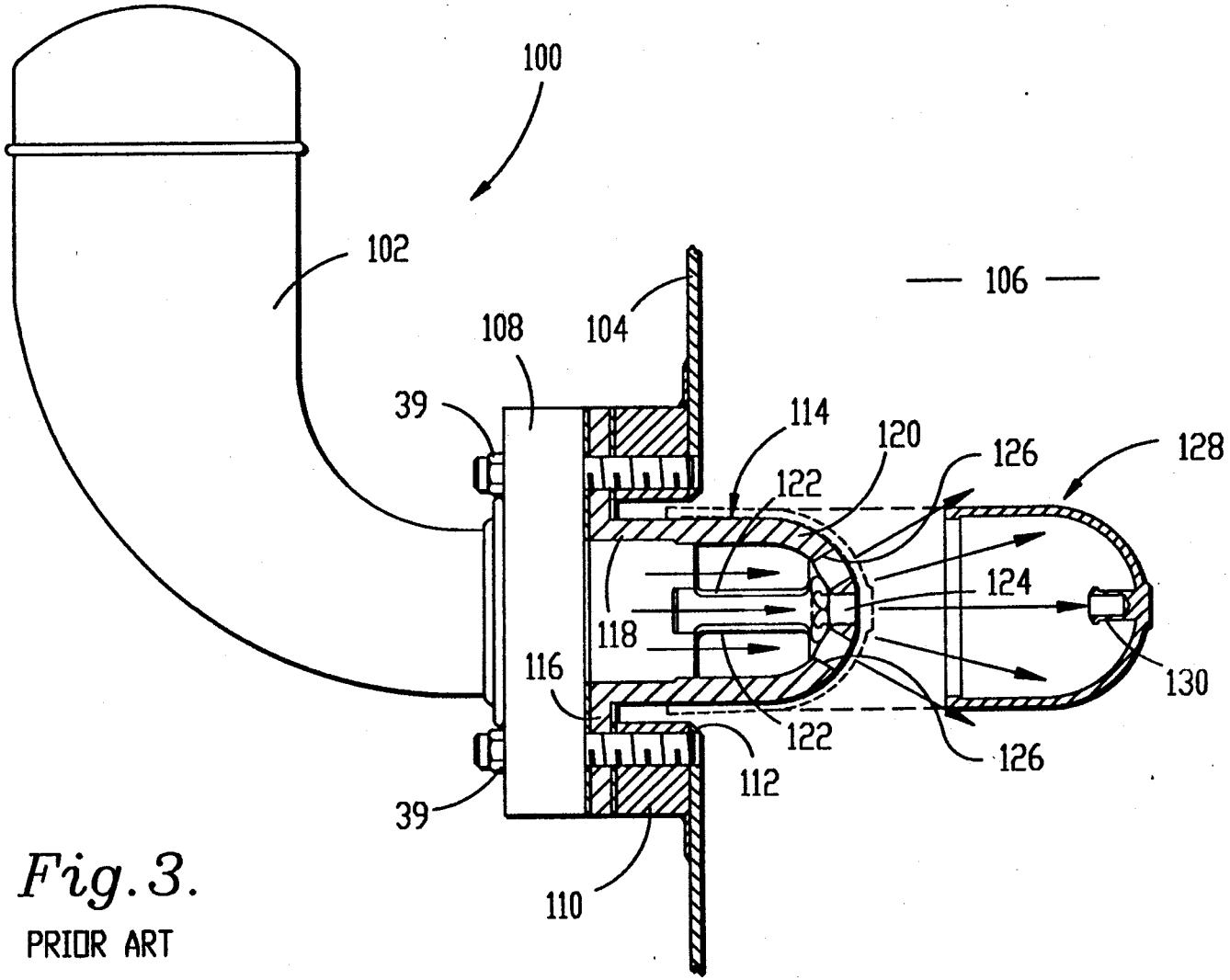
Fig. 3. PRIOR ART
FIG. 3 is a view similar to FIG. 2 but illustrating a prior art cover unit which is released into the area protected upon delivery of suppressant from the source thereof.

It is known to provide a fire or explosion suppression system broadly designated by the numeral 100 in FIG. 3 which conventionally is provided with a vessel 102 that contains a source of pressurized liquid or finely divided suppressant. System 100 is typically mounted on the wall 104 of a conduit, vessel or containment structure defining a part of an area 106 which is desirably protected from a fire or an explosion.

The flange 108 of vessel 102 is secured to a flange 110 mounted on wall 104 in complemental surrounding relationship to an opening 112 in the wall 104. An elongated nozzle 114 has a flange 116 which is clamped between flanges 108 and 110. The main generally cylindrical body portion 118 of nozzle 114 integral with flange 116 projects away from vessel 102 and has an integral semi-spherical end cap section 120. The cylindrical side wall of body portion 118 is provided with four enlarged openings 122 around the perimeter thereof, while end cap section 120 has a central orifice 124 which is surrounded by a series of similarly sized orifices 126.

The protective cup-shaped member 128 has an internal, axially positioned protuberance 130 configured to be received in central orifice 124 of nozzle 114. The cover 128 when mounted over nozzle 114 as shown by the dashed lines of FIG. 3 is functional to prevent accumulation of solid materials within the interior of the nozzle and also prevents agglomeration of material on the nozzle in a manner which would tend to clog or partially block the discharge openings or orifices of the nozzle.

It can also be observed from FIG. 3 that upon release of suppressant from vessel 102, cover 114 was forced from its position surrounding the nozzle into the protected area, thus mixing with the materials flowing through the area 106.

DESCRIPTION OF THE PREFERRED EMBODIMENT

The cover unit 10 of the present invention as illustrated in FIGS. 1, 2, 4 and 5 is also adapted to be mounted on a nozzle 12 of the type previously described with respect to the prior art depiction of FIG. 3.

Figure 2:
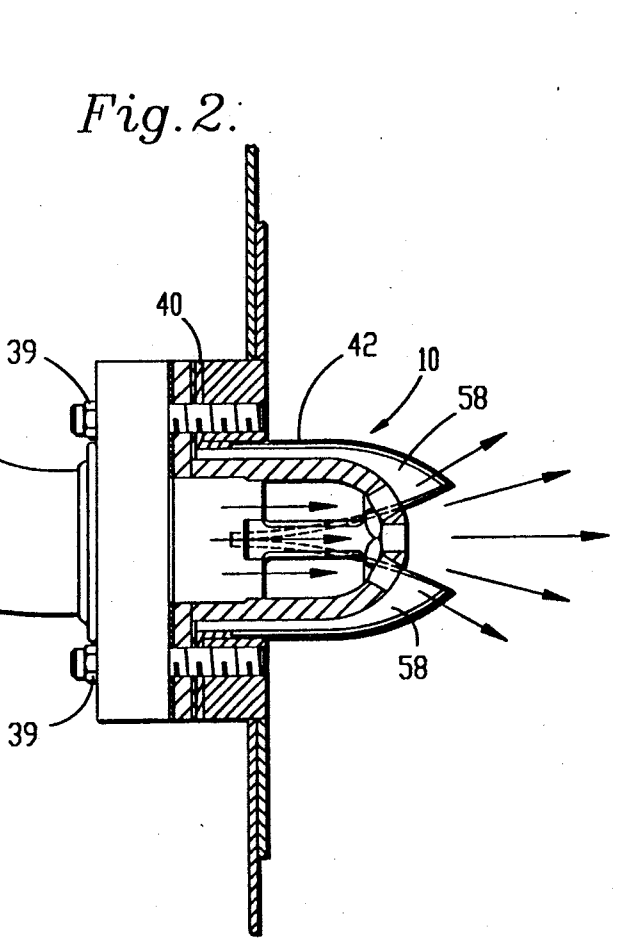
FIG. 2 is a side elevational view similar to FIG. 1 but illustrating the cover unit in the condition thereof as suppressant is being released from the suppressant source.
Figure 1:
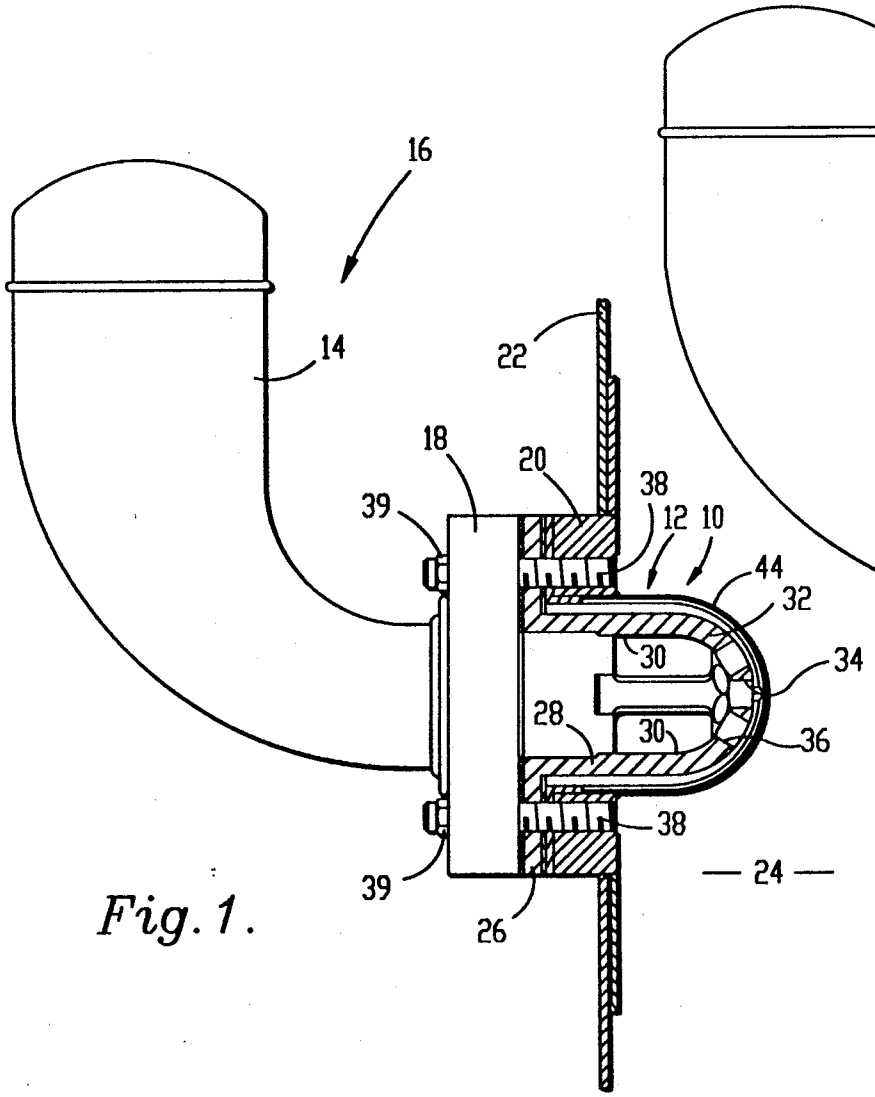
FIG. 1 is a side elevational view of a fire or explosion suppression system mounted on the side wall of an area to be protected by the system, with certain parts thereof being shown in section to better illustrate the construction of the invention.

As is apparent from FIG. 1, the vessel 14 of fire or explosion suppression system 16 has a flange 18 adapted to be secured to the flange 20 mounted on wall 22 of a conduit, a vessel or containment structure presenting an area 24 which is desirably to be protected from an explosion or a fire. Vessel 14 generally is filled with a liquid or finely divided solid suppressant under pressure.

Nozzle 12, as previously described with respect to nozzle 114, typically has a flange 26 which is clamped between flanges 18 and 20. The cylindrical, main body portion 28 of nozzle 12 has four polygonal, side discharge openings 30 which extend a substantial part of the longitudinal length of body portion 28. The semi-cylindrical end cap section 32 of nozzle 12 has orifice means in the nature of a central opening 34 aligned with the axis of main body portion 28, as well as a series of openings 36 in circumscribing relationship to central opening 34. Openings 34 and 36 are all essentially of the same diameter. A series of threaded studs 38 extending through flanges 20, 26 and 18 with nuts 39 thereon, function to releasably secure vessel 14 and nozzle 12 to the side wall 22 of the conduit, vessel or containment structure protected by system 16.

The cover unit 10 mounted over nozzle 12, is generally cup-shaped and has an annular peripheral flange 40 which is clamped between flange 20 of wall 22 and flange 18 of vessel 14 with the openings 41 in flange 40 receiving respective studs 38 for facilitating securement of the cover unit 10 to flanges 18 and 20. The side wall structure 42 of cover unit 10 is of generally cylindrical configuration and co-axial with the cylindrical main body portion 28 of nozzle 12. A generally semi-spherical end section 44 of cover unit 10 is integral with the outer marginal segment of side wall structure 42 and projects away from suppressant vessel 14 into the interior of area 24. It can be observed from FIG. 1 that cover unit 10 is configured and adapted to substantially envelop nozzle 12 in substantially conforming relationship to the portion thereof which extends into the protected area 24.

Cover unit 10 is desirably fabricated of an elastomeric material such as neoprene and has a side wall thickness of about 0.21 inch, which is essentially uniform throughout the extent thereof.

Figure 5:
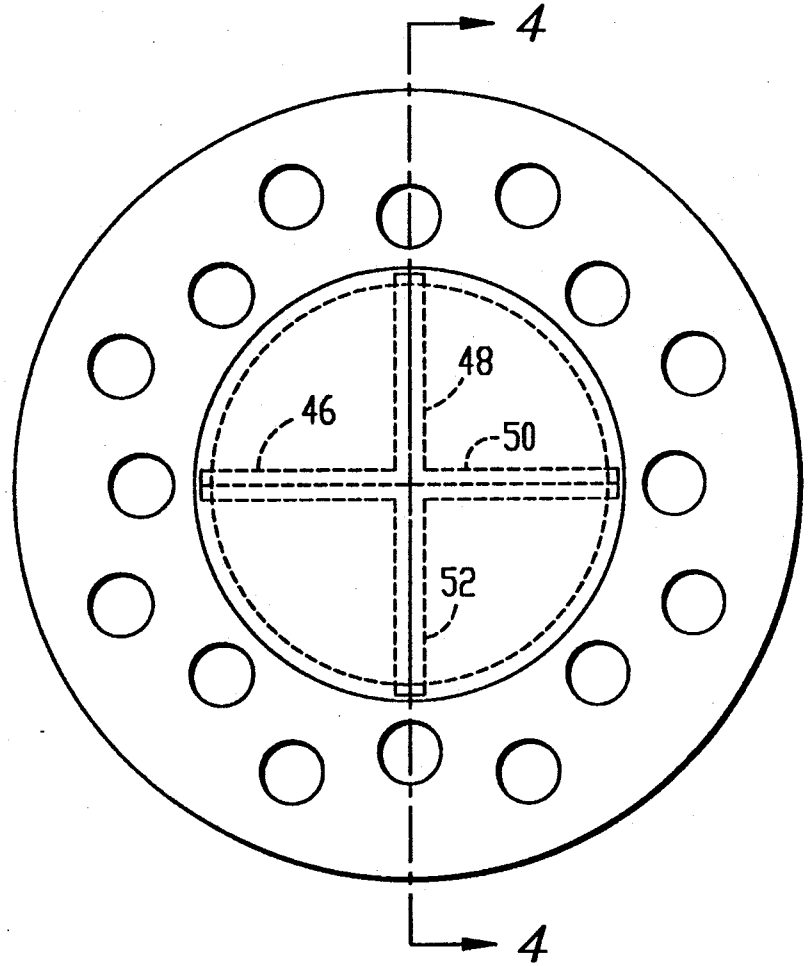
FIG. 5 is a end elevational view of the cover unit shown in FIG. 4.

The interior surface of cover unit 10 defined by elongated, generally cylindrical side wall portion 42 and semi-spherical end cap section 44 has four lines of weakness defined by V-shaped grooves 46, 48, 50 and 52, V-shaped in transverse cross-section which extend throughout the semi-spherical extent of end section 44 and merge at the apex of end cap section 44, to present a generally cross-shaped pattern as best illustrated in FIG. 5. The V-shaped grooves each are defined by converging surfaces 54 and 56 at an angle of approximate 90° with respect to one another. The distance from the apex of each groove 46–52 to the adjacent outermost face of the nozzle wall may be about 0.030 inch.

Figure 4:
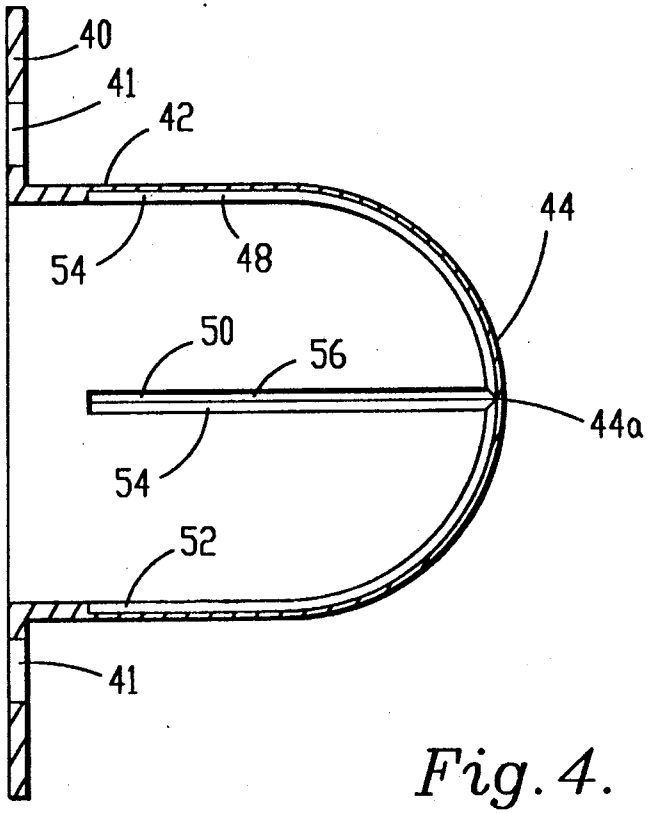
FIG. 4 is a vertical cross-sectional view of the cover unit of this invention, taken along the line 4—4 of FIG. 5.

As is apparent from FIG. 4, the grooves 46, 48, 50 and 52 extend through only a portion of the thickness of the wall structure defining cylindrical side wall 42 and end section 44.

It is also to be seen from FIG. 4 that each of the grooves 46–52 preferably extends along a substantial part of the full longitudinal length of side wall structure 42 but does terminate in spaced relationship from the flange 40. Furthermore, the lines of weakness 46, 48, 50 and 52 extend into and cross at substantially the apex 44*a* of semi-spherical end cap section 44.

In operation, the cover unit 10 protects nozzle 12 from materials in area 24 and prevents accumulation of the solid materials on the surfaces of the nozzle. In particular, cover unit 10 prevents clogging of openings 34 and 36 as well as agglomeration of solid particles which would tend to block outflow of suppressant through side discharge openings 30. It is to be understood in this respect that the orifices 34 and 36 serve as throttling means to assure that a proper proportion of the suppressant is released through side discharge openings 30. Thus, clogging of orifices 34 and 36 would have a detrimental effect on the operational characteristics on the suppressant system 16 and especially the release of suppressant by nozzle 12.

When suppressant is released from vessel 14, the pressurized liquid or powder is discharged through openings 30 and orifices 34 and 36, the pressurized suppressant impinging upon the inner surface of cover unit 10 causes rupture of the wall structure 42, 44 along the lengths of cross-pattern defining 46–52. The result is full opening of the cover unit 10 with triangular petal-shaped portions of the cover peeling away from nozzle 12 to allow unfettered release of the suppressant. The cover unit does not fragment which would cause undesirable discharge of the neoprene material into the area 24 for contamination of materials contained therein. Upon conclusion of the release of the suppressant, the petal-shaped areas 58 of the cover unit 10 tend to return to their initial protecting positions as shown in FIG. 1 of the drawings.

The cover unit 10 may then by readily replaced by replacement after removal of bolts 38.

We claim:

1. In a fire or explosion suppression system provided with a source of pressurized suppressant and a suppressant release nozzle having a portion which extends into an area protected by the system and wherein the nozzle has orifice means which can become clogged or impeded by materials present in said area, a protective cover for the nozzle comprising:

a cover unit of elastomeric material which is configured and adapted to substantially envelop in generally conforming relationship to at least the portion of the nozzle which extends into said protected area and that has said orifice means therein to prevent partial or total clogging of the nozzle orifice means by materials present in the protected area, said cover unit having rupturable wall structure provided with lines of weakness extending through only a portion of the wall structure and that will sever under a pressure less than the pressure required to effect rupture of the remaining portions of the wall structure upon a release of pressurized suppressant for delivery through the nozzle, said lines of weakness presenting a pattern that causes the wall structure on opposite sides of each line of weakness to deflect under the pressure of released suppressant flowing therepast without fragmenting of the wall structure into pieces that would be released into the protected area.

2. A protective cover for a fire or explosion suppression system as set forth in claim 1, wherein said pattern is a substantially cross-shaped pattern.

3. A protective cover for a fire or explosion suppression system as set forth in claim 1, wherein said cover unit is fabricated of neoprene.

4. In a fire or explosion suppression system provided with a source of pressurized suppressant and a generally cylindrical suppressant release nozzle having a portion which extends into an area protected by the system and wherein the nozzle has orifice means which can become clogged or impeded by materials present in said area, a protective cover for the nozzle comprising:

a cover unit provided with a generally cylindrical portion having a longitudinal length, said cylindrical portion being capped by a semi-spherical end section integral therewith, the extremity of the semi-spherical section remote from said cylindrical portion of the cover unit presenting an apex, said cover unit being configured and adapted to substantially envelop at least the portion of the nozzle which extends into said area and that has said orifice means therein to prevent partial or total clogging of the nozzle orifice means by materials present in said protected area, the cover unit generally cylindrical portion and semi-spherical end section having rupturable wall structure provided with lines of weakness that will sever under a pressure less than the pressure required to effect rupture of remaining portions of wall structure of the portion and section upon a release of pressurized suppressant for delivery through the nozzle, said lines of weakness presenting a pattern that causes the wall structure on opposite sides of each line of weakness to deflect under the pressure of released suppressant flowing therepast without fragmenting of the wall structure into pieces that would be released into the protected area.

5. A protective cover for a fire or explosion suppression system as set forth in claim 4, wherein said cover unit includes a peripheral flange projecting outwardly from the remaining portions of wall structure of the generally cylindrical portion in spaced relationship from the section, said peripheral flange being provided with means for facilitating securement of the cover unit in enveloping relationship to said nozzle.

6. A protective cover for a fire or explosion suppression system as set forth in claim 4, wherein said lines of weakness extend into and cross at substantially the apex of said semi-spherical end section of the cover unit.

7. A protective cover for a fire or explosion suppression system as set forth in claim 6, wherein said lines of weakness extend along a substantial part of the longitudinal length of the generally cylindrical portion of the cover unit in parallel relationship with a longitudinal axis of the generally cylindrical portion, and throughout the semi-spherical end section.

8. A protective cover for a fire or explosion suppression system as set forth in claim 7, wherein said lines of weakness are each made up of grooves in the wall structure of the cover unit, with each of the grooves being generally of V-shaped configuration in transverse cross-section.

9. A protective cover for a fire or explosion suppression system as set forth in claim 8, wherein each of said grooves faces inwardly of the cover unit.

10. A protective cover for a fire or explosion suppression system as set forth in claim 9, wherein said pattern is substantially a cross-shaped pattern.

* * * * *